United States Patent [19]

Sanford

[11] Patent Number: 4,582,072

[45] Date of Patent: Apr. 15, 1986

[54] CIGARETTE FILTER

[75] Inventor: Robert A. Sanford, Prospect, Ky.

[73] Assignee: Brown & Williamson Tobacco Corporation, Louisville, Ky.

[21] Appl. No.: 624,433

[22] Filed: Jun. 25, 1984

[51] Int. Cl.[4] ..... A24D 3/04

[52] U.S. Cl. ..... 131/336; 131/344; 131/361

[58] Field of Search ..... 131/336, 361, 338–341, 131/344

[56] References Cited

U.S. PATENT DOCUMENTS

| | | | |
|---|---|---|---|
| 3,490,461 | 1/1970 | Osmalov et al. | 131/336 |
| 4,380,241 | 4/1983 | Horsewell | 131/336 |
| 4,386,618 | 6/1983 | Cantrell | 131/336 |
| 4,393,885 | 7/1983 | Silberstein | 131/339 |
| 4,406,294 | 9/1983 | Lamb | 131/340 |
| 4,506,683 | 3/1985 | Cantrell et al. | 131/336 |
| 4,515,170 | 5/1985 | Cantrell et al. | 131/336 |
| 4,540,005 | 9/1985 | Cantrell et al. | 131/336 |

*Primary Examiner*—V. Millin
*Assistant Examiner*—H. Macey
*Attorney, Agent, or Firm*—Charles G. Lamb

[57] ABSTRACT

A filter for a cigarette includes a porous filter rod having a capillary smoke passageway extending coaxially therethrough and a hollow, generally cylindrical mouthpiece coaxially located with the filter rod at the mouth end of the filter rod. The filter rod is circumscribed by a non-porous wrapper, and the filter rod with the non-porous wrapper therearound is provided with grooves extending from the mouth end thereof a preselected distance longitudinally therealong. The mouthpiece is formed with air flow channels in flow communication with the grooves of the filter rod, and smoke flow channels in flow communication with that area of the filter rod mouth end between adjacent grooves of the filter rod. Tipping material circumscribes the filter rod and the mouthpiece, and is provided with flow-through openings therein in flow communication with the grooves.

14 Claims, 7 Drawing Figures

CIGARETTE FILTER

BACKGROUND OF THE INVENTION

1. Field of the Invention

This invention relates to filters for cigarettes. In one aspect it relates to a filter having a filter rod and coaxial mouthpiece with ventilating means in the filter rod. In even another respect the invention relates to a filter having a filter rod and coaxial mouthpiece for a cigarette having smoke directing means therein in combination with ventilating air means.

2. Description of the Prior Art

It is well known in the art to add filters to cigarettes wherein the filters are provided with ventilating means to bring ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough, thereby diluting the smoke in the stream. Also, the cigarette wrapper may be perforated at selected locations along the length of the cigarette which provides ports for the cigarette through which ventilating air enters. Even further, it is known to perforate the wrapper of the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; West German Pat. No. 2,302,677; British Pat. No. 1,414,745; British Pat. No. 1,360,612; British Pat. No. 1,360,611; and, U.S. Pat. No. 3,910,288, the aforementioned British patents being directed to non-wrapped acetate filters. Futhermore, there are a number of patents directed to the incorporation of centrally disposed tubes into a cigarette filter. These include, for example, U.S. Pat. No. 3,860,011; U.S. Pat. No. 4,037,524; U.S. Pat. No. 4,086,846; U.S. Pat. No. 4,022,221; U.S. Pat. No. 3,045,680; U.S. Pat. No. 3,621,851; U.S. Pat. No. 3,674,036; U.S. Pat. No. 4,109,666; and U.S. Pat. No. 4,256,122. Further, U.S. Pat. No. 4,380,241 relates to a non-filtering cigarette mouthpiece including a centrally disposed smoke flow tube.

SUMMARY OF THE INVENTION

The present invention advantageously provides a straight forward arrangement of a filter for a cigarette which in one form achieves normal cigarette pressure drop with low to high efficiency filters. The present invention further provides a cigarette filter for lowering tar by ventilation as well as filtration. The present invention even further provides a filter ventilation system for a cigarette utilizing grooves in the filter plug extending from tipping perforations in the tipping paper to the mouth end of the filter. The present invention also provides a grooved filter with a non-porous plug wrap. The present invention even also provides means for directing an unfiltered, undiluted smoke stream through a filter to the center thereof and simultaneously therewith provides means for directing ventilating air along the outer surface thereof.

Various other features of the present invention will become obvious to those skilled in the art upon reading the disclosure set forth hereinafter.

More particularly, the present invention provides a filter for a cigarette comprising: a porous filter rod of cylindrical configuration; means defining a smoke flow capillary passageway formed concentrically with the longitudinal axis of the filter rod and extending longitudinally therethrough; a wrapper circumscribing the filter rod leaving flow-through opposed ends of the filter rod, the wrapper having a plurality of longitudinally extending grooves embedded into the filter rod, at least that portion of the wrapper defining each groove being impervious, the grooves being open ended at the mouth end of the filter rod and extending from the mouth end a distance less than the length of the filter rod; a hollow, generally cylindrical mouthpiece coaxially located with said filter rod at the mouth end of the filter rod, the hollow interior of the mouthpiece being open at both ends of the mouthpiece, the circumferential wall of the mouthpiece being formed with a plurality of air flow channels extending generally longitudinally of the mouthpiece from one and to the other end of the mouthpiece, the air flow channels being in flow communication with the open ends of the grooves at the mouth end of the filter rod, the circumferential wall of the mouthpiece being formed with a plurality of filtered smoke flow channels extending generally longitudinally of the mouthpiece from one end to the other end of the mouthpiece, the filtered smoke flow channels being in flow communication with that area of the filter rod mouth end between adjacent grooves of the filter rod, and the hollow interior of the mouthpiece being in flow communication with the smoke flow capillary; and, tipping material extending longitudinally of and circumscribing the filter rod and mouthpiece, the tipping material including means for introducing ventilating air into the grooves of the filter rod, ventilating air being the only fluid flowing through the grooves and through the air flow channels in the mouthpiece when a cigarette having the filter is smoked.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
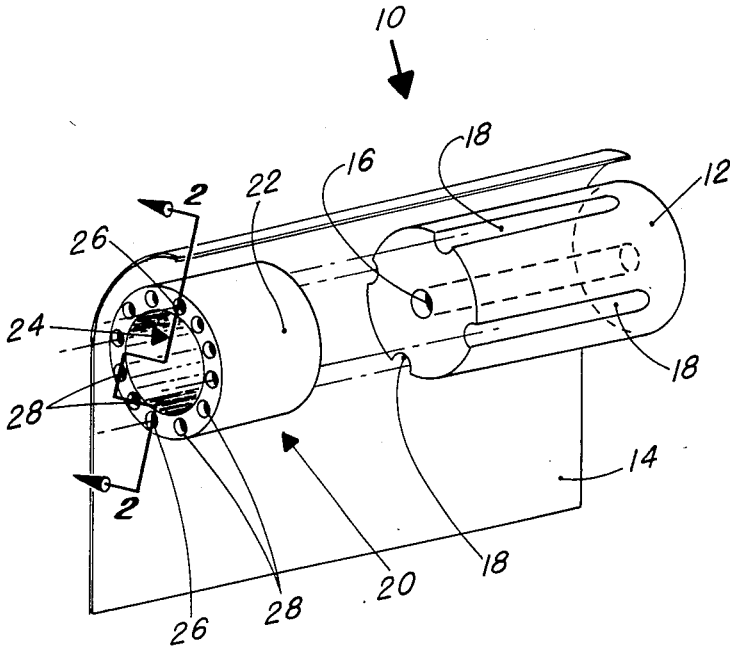
FIG. 1 is an exploded, perspective view of one preferred filter of the present invention.
Figure 2:
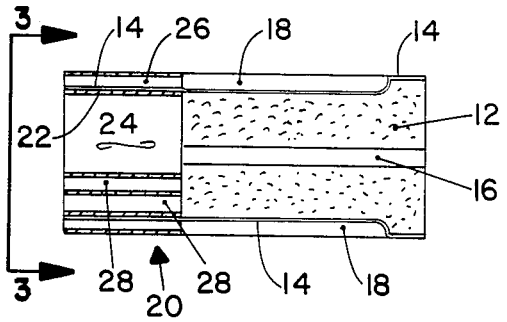
FIG. 2 is a longitudinal cross-sectional view of the filter of FIG. 1 as viewed in the direction of arrows 2—2 of the section line in FIG. 1.

In FIGS. 1 and 2, a filter 10 of the present invention is shown. This filter 10 comprises a cellulose acetate filter rod 12 made from fibrous or foamed materials for tobacco smoke which may be known in the art circumscribed by a non-porous wrapper 14. It is realized that in the use of the term "non-porous wrapper", this includes non-porous outer surfaces of foamed material which are integral with the filter element as well as non-porous wrapping material which is not integral with the filter element. A smoke flow capillary passageway 16 is formed concentrically with the longitudinal axis of the filter rod 10 extending longitudinally from one end (tobacco end) to the other end (mouth end) of the filter rod 12. The smoke flow capillary passageway 16 can, for example, be an extrusion. The wall of the capillary passageway 16 can be either pervious or impervious. Furthermore, the filter rod 12 is provided with a plurality of grooves 18 therein extending longitudinally therealong from the mouth end of filter rod 12 a predetermined distance less than the entire length of the filter rod 12. The filter rod 12 are generally prepared by taking a standard filter rod of cellulose acetate or the like, wrapping the rod with a non-porous wrapping material, then subjecting the wrapped filter rod to a mold or other treating means designed for putting appropriate grooves therein. One such method is known as a heat molding technique, which is well known in the art.

Figure 3:
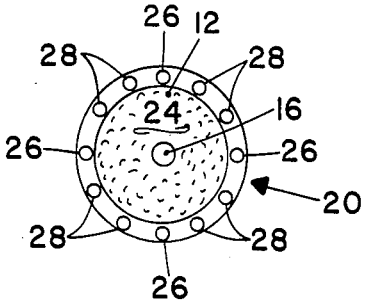
FIG. 3 is an end view of the filter of FIGS. 1 and 2 as viewed in the direction of arrows 3—3 in FIG. 1.

With continued reference to FIGS. 1 and 2, and additional reference to FIG. 3, the filter 10 also includes a generally cylindrical, hollow mouthpiece 20 coaxially located with the filter rod 12 at the filter rod mouth end. The mouthpiece 20 is formed by a circumferential wall 22 which defines the generally hollow interior 24. The hollow interior 24 is open at both ends of the mouthpiece 20, and has a smaller radius than the radial distance from the smoke flow capillary 16 to the grooves 18 at the filter rod mouth end. The circumferential mouthpiece wall 22 is preferably fabricated of an impermeable material such as, for example, a plastic, and can be manufactured by extrusion. The circumferential wall 22 is formed with a plurality of circumferentially spaced apart air flow channels 26 extending generally longitudinally of the mouthpiece and, being open to both ends of the mouthpiece. As shown, the air flow channels 26 are formed through the body of the circumferential wall 22. The air flow channels 26 are located in air flow communication with the grooves 18 of the filter rod 12. As illustrated, the number of air flow channels 26 is equal to the number of grooves 18 with each air flow channel 26 in flow communication with a different one of the grooves 18. However, it is contemplated that the number of air flow channels 26 can be greater than the number of grooves 18, and that more than one air flow channels 26 will, therefore, be in flow communication with each one of the grooves 18. In addition, the circumferential mouthpiece wall 22 is formed with a plurality of circumferentially spaced apart filtered smoke flow channels 28 extending generally longitudinally of the mouthpiece 20 and being open to both ends of the mouthpiece. As shown, the filtered smoke flow channels 28 are formed through the body of the circumferential wall 22. The filtered smoke flow channels 28 are located in smoke flow communication with that area of the filter rod mouth end between adjacent grooves 18 of the filter rod 12. As shown, each of the air flow channels 26 has substantially the same flow through area as each of the smoke flow channels 28. Further, the air flow channels 26 and smoke flow channels 28 are radially spaced from the longitudinal axis of the filter 10 by the same dimension. The hollow interior 24 of the mouthpiece 20 is in flow communication with the smoke flow capillary passageway 16 and with that portion of the filter 12 radially inwardly of the portion of the filter rod 12 in flow communication with the smoke flow channels 28 at the filter rod mouth end. Toward this end, the circumferential mouthpiece wall 22 is thicker than the depth of the outlet end of the grooves 18 at the filter rod mouth end.

Figure 4:
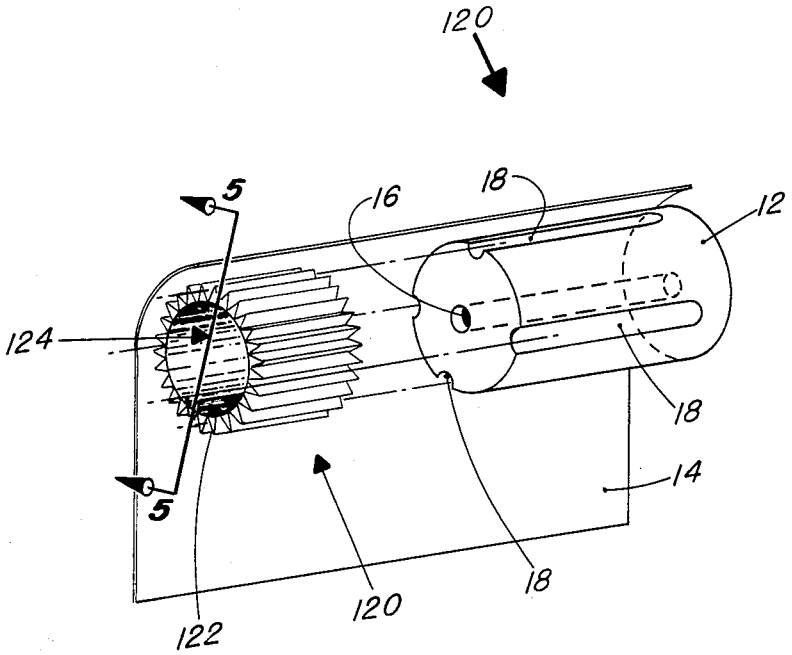
FIG. 4 is an exploded, perspective view of another preferred filter of the present invention.
Figure 5:
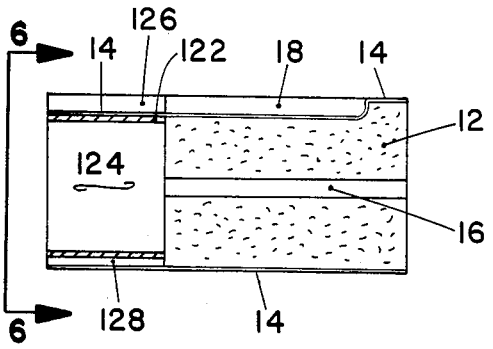
FIG. 5 is a longitudinal cross-sectional view of the filter of FIG. 4 as viewed in the direction of arrows 5—5 of the section line in FIG. 4.
Figure 6:
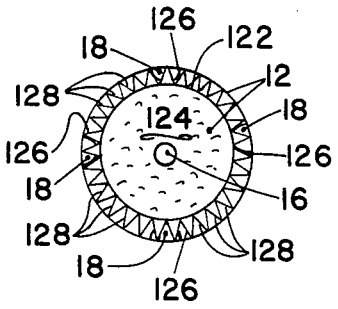
FIG. 6 is an end view of the filter of FIGS. 4 and 5 as viewed in the direction of arrows 6—6 in FIG. 5; and, FIG. 7 is a cross-sectional side view of the filter of FIGS. 1-6 attached to a cigarette.

With reference to FIGS. 4-6, there is shown another advantageous embodiment of the hollow, generally cylindrical mouthpiece of the present invention, denoted generally as the numeral 120. The mouthpiece 120 is formed by a circumferential wall 122 which defines the generally cylindrical hollow interior 124. The hollow interior 124 is open at both ends of the mouthpiece 120. The circumferential wall 122 if formed with a plurality of circumferentially spaced apart air flow channels 126 extending longitudinally of the mouthpiece and being open to both ends of the mouthpiece. As shown in FIGS. 4-6, the air flow channels 126 are defined by serrations formed in the outer peripheral surface of the circumferential wall 122. The circumferential mouthpiece wall 122 is also formed with a plurality of circumferentially spaced apart filtered smoke flow channels 128 extending generally longitudinally of the mouthpiece 120 and being open to both ends of the mouthpiece. As shown, the filtered smoke flow channels 128 are defined by serrations formed in the outer peripheral surface of the circumferential wall 122. The air flow channels 126 are in flow communication with the filter rod grooves 18, on the filtered smoke flow channels 128 are located in smoke flow communication with that area of the filter rod mouth end between adjacent grooves 18 of the filter rod 12. FIGS. 4-6 illustrate the serrations defining the air flow channels 126 and the serrations defining the smoke flow channels 128 as being substantially identical in size and shape, and uniformly circumferentially spaced apart about the mouthpiece wall. That is, the outer peripheral surface of the circumferential mouthpiece wall 122 is formed with uniform serrations therearound and extending longitudinally therealong. As with the mouthpiece 20 of FIGS. 1-3, the hollow interior 124 of the mouthpiece 120 is in flow communication with the smoke flow capillary passageway 16 and with that portion of the filter rod mouth end radially inwardly of the portion of filter rod in flow communication with the smoke flow channels 128 at the filter rod mouth end. This is accomplished by making the circumferential wall 122 of the mouthpiece thicker than the depth of the grooves 18 at the filter rod mouth end.

The mouthpiece 20, 120 is attached to the filter rod 12 by means of the non-porous wrapper 14. Toward this end, as can be seen in FIG. 7, the wrapper 14 extends beyond the mouth end of the filter rod 12 and in circumferential overlaying relationship to the mouthpiece.

Figure 7:
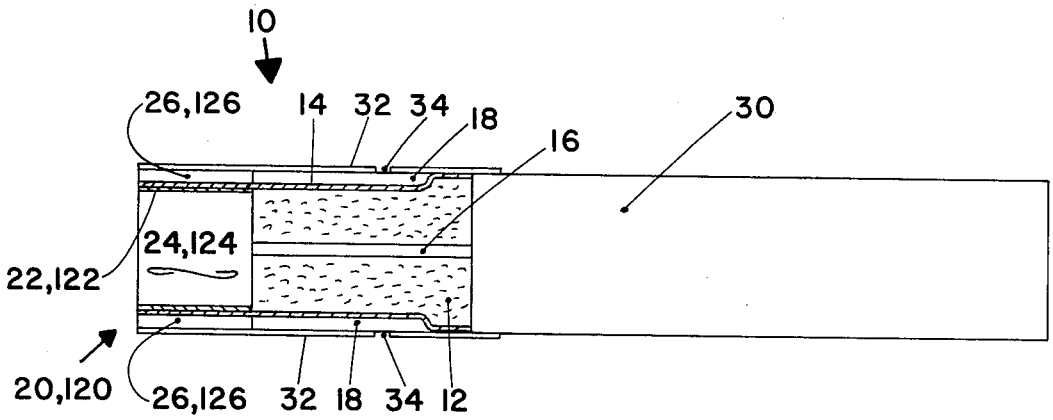

FIG. 7 illustrates the filter 10 attached to a tobacco column or cigarette 30 and wrapped by tipping paper 32. The tipping paper 32 extends longitudinally of the filter 10 circumscribing the wrapper 14 holding the mouthpiece 20, 120 to the filter rod 12, and circumferentially overlaps a portion of the end of the tobacco column 30 thereby attaching the filter 10 to the tobacco column. The tipping paper 32 is formed with a plurality of perforations 34 therein circumferentially surrounding filter rod 12 of the filter 10 and disposed in alignment with the grooves 18 wherein ventilating air radially enters the grooves 18 through the perforations 34. It is realized that in the use of the term "tipping paper" this may include commercially available tipping paper in combination with an air permeable wrapper which is used in the assembly of the filter prior to attachment to a tobacco column. As shown in FIG. 7, ventilating air enters through the tipping perforations 34 traveling down the grooves 18 and toward the smoker's mouth through the air flow channels 26, 126 of the mouthpiece 20, 120, respectively. The smoke flow capillary passageway 16 is disposed to concentrate the smoke in the central portion of the filter rod 12 for directing a stream of unfiltered, undiluted smoke into the hollow interior 24, 124 of the mouthpiece 20, 120, respectively, toward the mouth of the smoker. Concurrently, a portion of filtered smoke flows from the area of the filter rod 12 between adjacent grooves 18 and into the filtered smoke channels 22, 122 of the mouthpiece 20, 120, respectively, toward the smoker's mouth, while another portion of smoke flows from that area of the mouth end of the filter rod 12 encompassing the capillary passageway 16 into the hollow mouthpiece interior 24, 124 surrounding the stream of unfiltered smoke issuing from the capillary passageway 16 directed toward the smoker's mouth. The filtered smoke entering the smoke flow channels 28, 128 from the filter rod 12 is accelerated and enters the smoker's mouth in streams adjacent the air streams entering the smoker's mouth from the air flow channels 26, 126. The filtered smoke entering the hollow interior 24, 124 of the mouthpiece from the filter rod 12 is generally evenly distributed about the unfiltered smoke stream entering the hollow interior 24, 124 from the smoke flow capillary 16 moving at a slower velocity than the stream of unfiltered smoke from the capillary passageway 16.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. a filter for a cigarette comprising:

a porous filter rod of cylindrical configuration;

means defining a smoke flow capillary passageway formed concentrically with the longitudinal axis of the filter rod and extending longitudinally therethrough;

a wrapper circumscribing the filter rod leaving flow-through opposed ends of the filter rod, the wrapper having a plurality of longitudinally extending grooves embedded into the filter rod, at least that portion of the wrapper defining each groove being impervious, the grooves being open ended at the mouth end of the filter rod and extending from the mouth end a distance less than the length of the filter rod;

a hollow, generally cylindrical mouthpiece defined by a circumferential wall coaxially located with said filter rod at the mouth end of the filter rod, the hollow interior of the mouthpiece being open at both ends of the mouthpiece, the circumferential wall of the mouthpiece being formed with a plurality of air flow channels extending generally longitudinally of the mouthpiece from one end to the other end of the mouthpiece, the air flow channels being in flow communication with the open ends of the grooves at the mouth end of the filter rod, the circumferential wall of the mouthpiece being formed with a plurality of filtered smoke flow channels extending generally longitudinally of the mouthpiece from one end to the other end of the mouthpiece, the filtered smoke flow channels being in flow communication with that area of the filter rod mouth end between adjacent grooves of the filter rod, and the hollow interior of the mouthpiece being in flow communication with the smoke flow capillary; and, tipping material extending longitudinally of and circumscribing the filter rod and mouthpiece, the tipping material including means for introducing ventilating air into the grooves of the filter rod, ventilating air being the only fluid flowing through the grooves and through the air flow channels in the mouthpiece when a cigarette having the filter is smoked.

2. The filter of claim 1, wherein the hollow interior of the mouthpiece is in flow communication with that portion of the filter rod radially inwardly of the portion of the filter rod in flow communication with the smoke flow passages at the filter rod mouth end.

3. The filter of claim 1, wherein the air flow channels are circumferentially spaced apart about the circumferential wall of the mouthpiece.

4. The filter of claim 1, wherein the filtered smoke flow channels are circumferentially spaced apart about the circumferential wall of the mouthpiece.

5. The filter of claim 1 wherein:

the air flow channels are circumferentially spaced apart about the circumferential wall;

the smoke flow channels are circumferentially spaced apart about the circumferential wall; and, the smoke flow channels are located in the spaces between adjacent air flow channels.

6. The filter of claim 5, wherein the air flow channels are formed through the circumferential wall of the mouthpiece.

7. The filter of claim 5, wherein the air flow channels are formed through the circumferential wall of the mouthpiece.

8. The filter of claim 5, wherein the air flow channels are formed in the outer peripheral surface of the circumferential mouthpiece wall.

9. The filter of claim 5, wherein the smoke flow channels are formed in the outer peripheral surface of the circumferential mouthpiece wall.

10. The filter of claim 5, wherein the air flow channels and the smoke flow channels are mutually uniformly spaced apart circumferentially of the mouthpiece wall.

11. The filter of claim 5, wherein the air flow channels and the smoke flow channels are substantially identical in size and shape.

12. The filter of claim 1, wherein the circumferential mouthpiece wall is thicker than the depth of the grooves at the filter rod mouth end.

13. The filter of claim 1, wherein the wrapper extends beyond the mouth end of the filter rod and in circumferential overlaying relationship to the cylindrical mouthpiece.

14. The filter of claim 1, wherein the mouthpiece is fabricated of an impermeable material.

* * * * *